US005571260A

United States Patent [19]

Krug

[11] Patent Number: 5,571,260

[45] Date of Patent: Nov. 5, 1996

[54] PORTABLE LIQUID CONTAINER AND DISPENSER SYSTEM

[76] Inventor: Schani Krug, 267 Mast Rd., Durham, N.H. 03824

[21] Appl. No.: 551,855

[22] Filed: Nov. 7, 1995

[51] Int. Cl.[6] ..... B67D 5/64

[52] U.S. Cl. ..... 222/175; 224/148.2; 224/660; 224/901.4

[58] Field of Search ..... 222/175; 324/148

[56] References Cited

U.S. PATENT DOCUMENTS

| | | | |
|---|---|---|---|
| 4,903,864 | 2/1990 | Sirhan | 222/175 X |
| 4,997,110 | 3/1991 | Swenson | 222/175 |
| 5,060,833 | 10/1991 | Edison et al. . | |
| 5,085,349 | 2/1992 | Fawcett | 222/175 |
| 5,104,016 | 4/1992 | Runkel | 222/175 |
| 5,135,144 | 8/1992 | Blakely et al. . | |
| 5,158,212 | 10/1992 | Sirhan | 222/175 |
| 5,195,948 | 3/1993 | Hill et al. . | |
| 5,224,637 | 7/1993 | Colombo . | |
| 5,244,136 | 9/1993 | Collaso . | |
| 5,370,278 | 12/1994 | Raynie | 222/175 |
| 5,372,565 | 12/1994 | Burdenko . | |
| 5,396,906 | 3/1995 | Harrold . | |
| 5,431,308 | 7/1995 | Tchen | 222/175 |

*Primary Examiner*—Gregory L. Huson
*Attorney, Agent, or Firm*—Ray F. Cox, Jr.

[57] ABSTRACT

A portable liquid container and dispenser system having a bladder for holding a liquid, a belt for securing the bladder about the waist of a user, a pump in fluid connection with the bladder, a power source for the pump, and a hose in fluid connection with the pump for delivering the liquid to a user. The bladder may be disposed within a protective pouch, and a remote switch may be provided to facilitate easy activation and deactivation of the pump. The switch may be located on the hose for added convenience.

23 Claims, 3 Drawing Sheets

FIG. 1
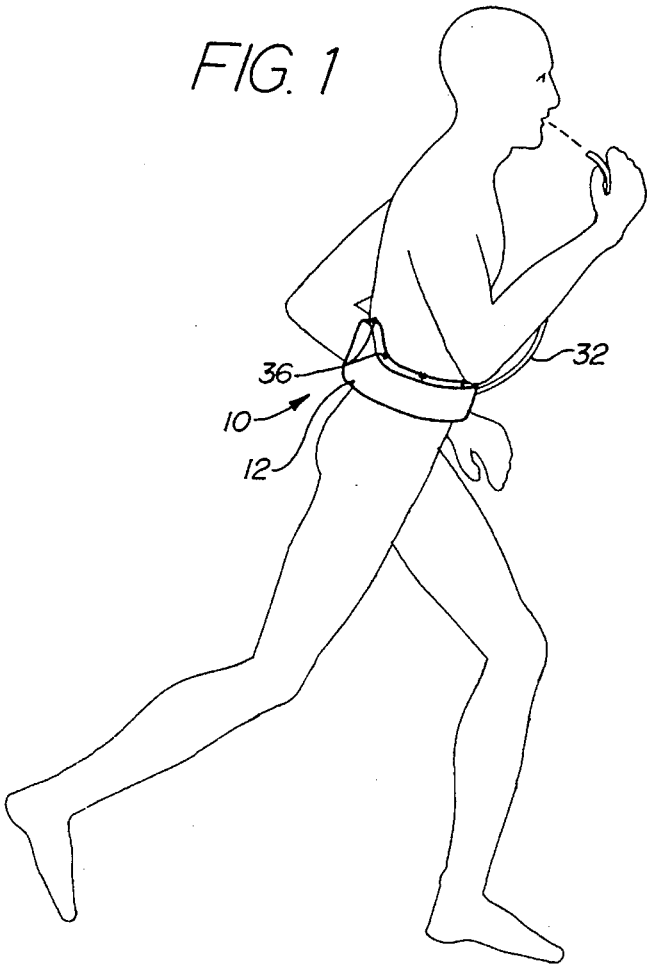
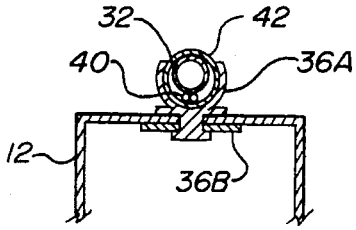
FIG. 2A
FIG. 2
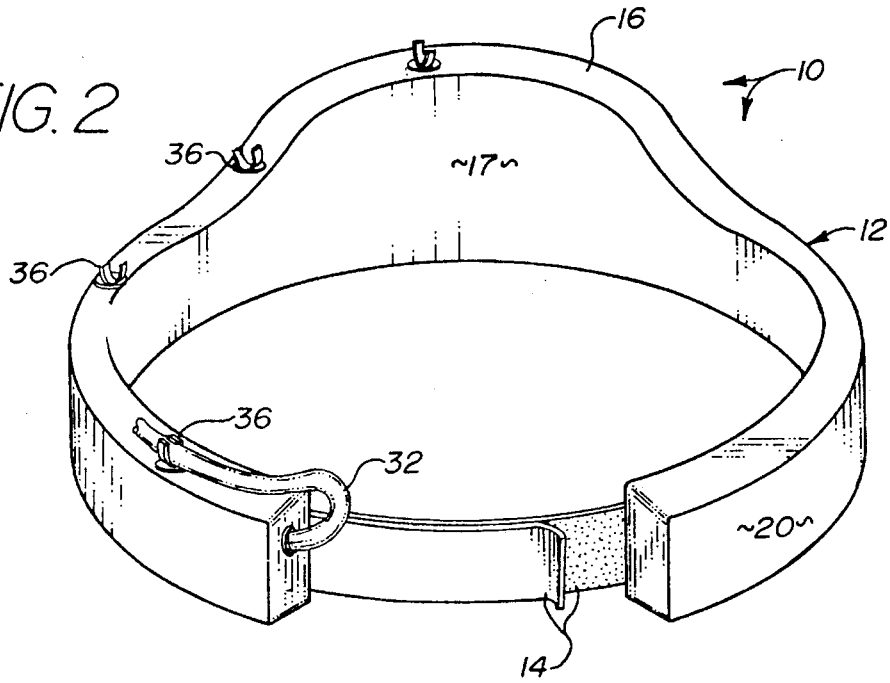

PORTABLE LIQUID CONTAINER AND DISPENSER SYSTEM

FIELD OF THE INVENTION

The present invention relates to a portable liquid container and dispenser system and more particularly to portable liquid container and dispenser system for use during exercise or physical activity.

BACKGROUND OF THE INVENTION

Rehydration of the human body is important for proper health and cooling of the body. Health care experts extol the virtues of regular fluid replenishment during dieting. During high temperature days of summer, water replenishment is crucial. Most individuals replace lost body fluids by drinking appropriate fluids when the body signals that it is thirsty, and by eating high water content foods. This chore is easily accomplished by visiting the refrigerator or by finding a water fountain. There are situations, however, where a visit to a refrigerator or fountain is inconvenient.

A person engaged in exercise will find it difficult and self-defeating to pause in order to retrieve water or other liquid. Many sports, such as running, biking, aerobics, and tennis, among others, require disengagement from the physical activity in order to rehydrate. This diminishes the beneficial results achieved and results in a lower level of satisfaction for the exerciser. However, persons engaged in such physical activities, lose body water at an extremely rapid rate. If these persons do not rehydrate regularly, their physical and mental performance will deteriorate rapidly, and in extreme cases, serious physical repercussions may result. In order to achieve body rehydration, these athletes typically carry a water bottle, drawing on it as needed. Although fluid replenishment is achieved, the water bottle tends to be a burden. In many cases, such as in tennis games, the holding of a water bottle is not feasible.

Some of the disadvantages of water bottles are solved by back pack style water containers which are carried on a user's back and use a flexible hose to permit a user to draw upon the fluid contained within the back pack. While these devices free the user's hands, these devices are not without problems. For example, as the device is part of a back pack structure, a heavy load is introduced onto the upper back of the user. This puts an inordinate strain upon the upper back. Furthermore, the device raises the center of gravity of the wearer resulting in loss of balance and diminished physical performance. These devices also lack the flexibility to permit users to easily make different uses of the liquid, such as pouring or spraying the liquid over the user's head or body for cooling or sharing the liquid with others.

SUMMARY OF THE INVENTION

It is therefore an object of the present invention to provide a portable fluid container and dispenser system that frees up a user's hands.

It is a further object of the present invention to provide a device of the above type which may be worn by a user without creating an unnecessary burden on the body of the user.

It is a still further object of the present invention to provide a device of the above type which does not put an inordinate strain upon the upper back of the user and does not raise the center of gravity of the user.

It is a still further object of the present invention to provide a device of the above type which utilizes a pump to provide a pressurized stream of liquid to a user.

It is a still further object of the present invention to provide a device of the above type having a switch conveniently located remotely from the pump for ease of operation.

It is a still further object of the present invention to provide a device of the above type that offers the user the flexibility to easily pour or spray the liquid over the user's head or body or to easily share the liquid with others.

Toward the fulfillment of these and other objects and advantages, the present invention is direct toward a portable liquid container and dispenser system. The system has a bladder for holding a liquid, means for securing the bladder to a desired object, a pump in fluid connection with the bladder, a power source for the pump, and a hose in fluid connection with the pump for delivering the liquid to a user. The bladder may be disposed within a protective pouch, and a remote switch may be provided to facilitate easy activation and deactivation of the pump. The switch may be located on the hose for added convenience and may also be voice activated to further free the user's hands.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein:

FIG. 1 is a perspective view of a belt of the present invention in use;

FIG. 2 is a front elevation view of a belt of the present invention;

FIG. 2A is sectional view of retention means for a belt of the present invention;

Similar reference numerals refer to similar parts throughout the several views of the drawings.

DETAILED DESCRIPTION OF THE PREFERRED EMBODIMENT

Figure 7:
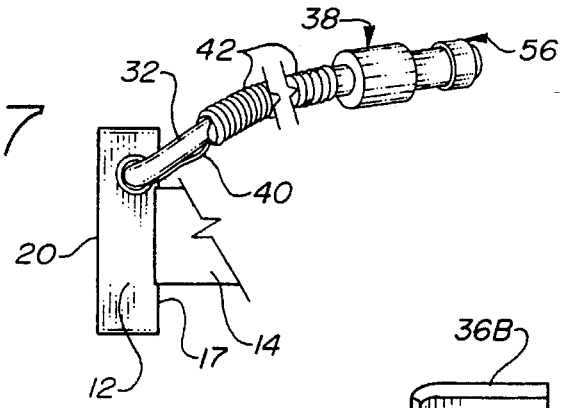
FIG. 7 is a side elevation view of a belt of the present invention.

Referring to FIG. 1, reference numeral 10 refers in general to a portable liquid container and dispenser system of the present invention in the form of a belt, the preferred embodiment. The belt of the present invention comprises a back support belt 10 of the type typically worn by weight lifters. As shown in FIG. 2, the belt 10, which is designed and dimensioned to fit around a person's waist in order to provide back support, has a pliable pouch or support portion 12 and a pair of straps 14 extending from either end of the pouch. When the belt 10 is worn, the support portion 12 contacts the user's back while the straps 14 encompass the wear's body in order to secure the belt 10 in place. The straps 14 are designed to connect to one another in any conventional manner in order to securely hold the belt 10 in place around the user's waist. Connection methods for the straps 14 can include Velcro brand hook and loop attachments, a buckle, or any other standard connection device. The belt 10 can be made of nylon, leather, or any other suitable material.

The pouch 12 may be generally rectangular, or as shown, may include a hump 16, for increased back support. The pouch 12 has an inner surface 17, which contacts the wearer's back, and an outer surface 20. Disposed within the pouch 12 is a pliable bladder 22 for holding fluids. A fill cap 24 provides a convenient fill access to the bladder 22. Access to the bladder 22 disposed within the pouch is provided by a zipper 26 located on the outer surface 20. Reflective material 27 such as a reflective tape or vinyl strip may be applied to the outer surface 20 for safety reasons.

A pump 28, in fluid connection with the bladder 22 via draw line 30, is also disposed within the pouch 12 between the inner surface 18 and the outer surface 20. Draw line 30 has portions 30A and 30B which connect to lower portions of the bladder 22 at opposite ends to avoid starving the pump 28. A flexible hose 32 is also in fluid connection with the pump 28. The end of the flexible hose 32 may be received within the user's mouth. The pump 28 draws fluid from the bladder 22 and pumps the fluid through the flexible hose 32 where the fluid is retrieved by the user. Power source or batteries 34 provides electrical power to the pump 28.

Figure 2B:
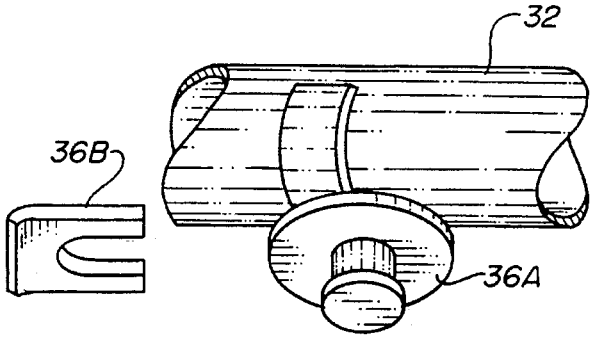
FIG. 2B is a perspective view of the retention means of FIG. 2A.
Figure 3:
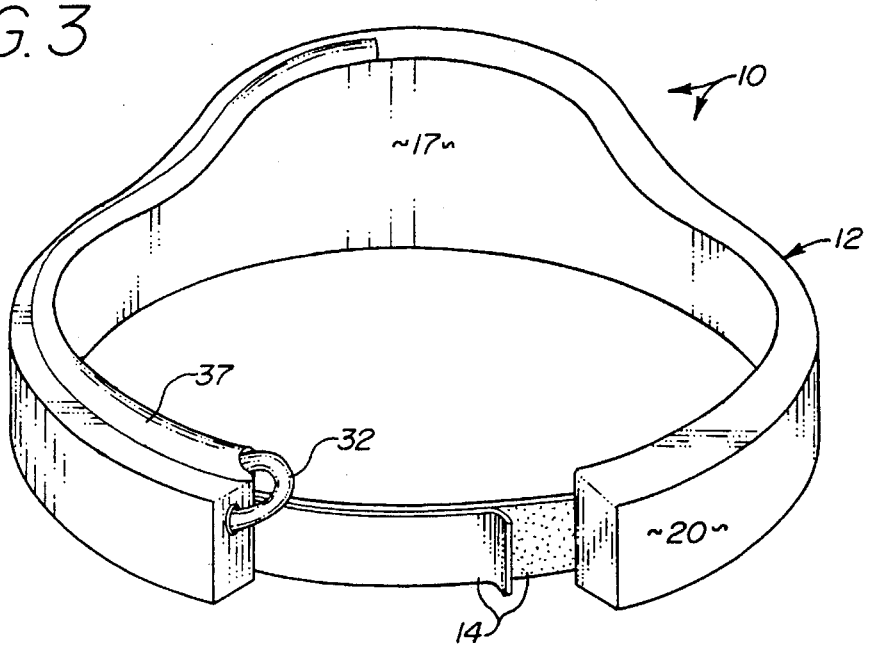
FIG. 3 is a front elevation view of an alternate embodiment of a belt of the present invention.
Figure 4:
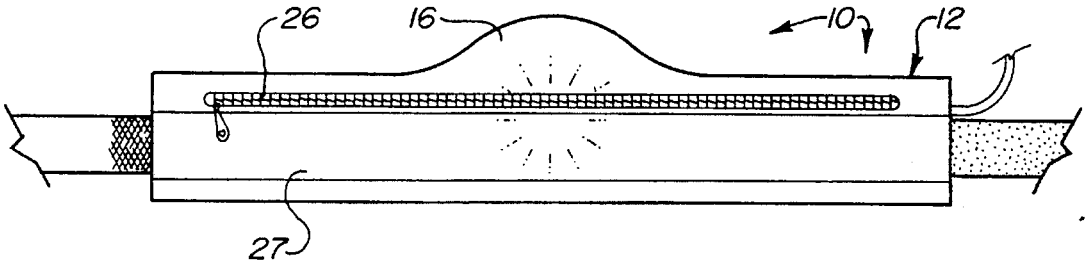
FIG. 4 is a rear elevation view of a belt of the present invention.
Figure 5:
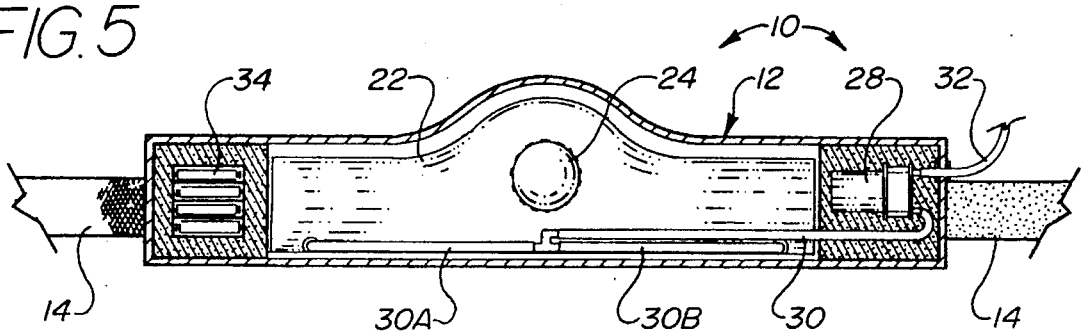
FIG. 5 is a rear sectional view of a belt of the present invention.
Figure 6:
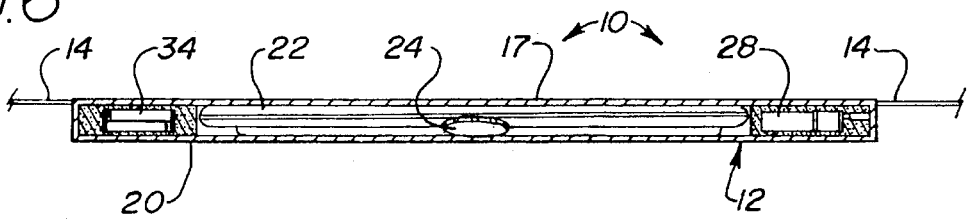
FIG. 6 is a top sectional view of a belt of the present invention.

As shown in FIG. 2, one or more retainers may be used to route the hose 32 to a center portion of the belt 10 so that the hose 32 may be routed in a convenient location up a user's back. In the preferred embodiment, shown in FIGS. 2A and 2B, the retainer is in the form of clips 36, each clip having an upper portion 36A releasably secured to the hose 32 and a base 36B secured to the belt 10. The hose 32 is easily secured in and removed from the clips 36 to provide the user with added flexibility to route the hose 32 as the user desires. FIG. 3 shows an alternate embodiment in which the retainer is in the form of a sleeve 37 secured to the belt 10. It is understood that any conventional means may be used to secure the hose 32 to the belt, and that retainers may be secured to other objects to route the hose 32 as desired. It is further understood that such retainers need not be used.

The pump 28 is activated by a switch 38. The switch 38 can be located directly on the belt 10 wherein the user can reach down to activate the switch. Alternately, the switch 38 can be remotely located so as to be held in the user's hand. In such an arrangement, the user is not required to reach down to the belt in order to activate it. Alternately, the switch 38 can be located on the end of the flexible hose 32. In this arrangement, as best shown in FIG. 7, wires 40 forming an electrical circuit that includes the power supply 34 and pump 28 extend from the pouch 12 and along the hose 32 to the switch 38. The wires 40 are held in place using flexible tubing 42 disposed coaxially about the hose 32. For ease of presentation, only one wire 40 is depicted in FIG. 7.

Figure 8:
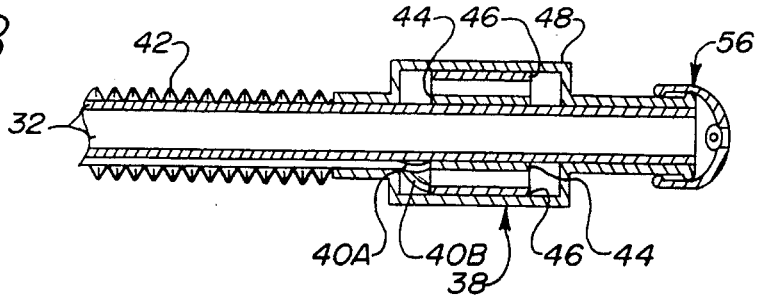
FIG. 8 is a sectional view of a remote switch located on a hose.
Figure 9:
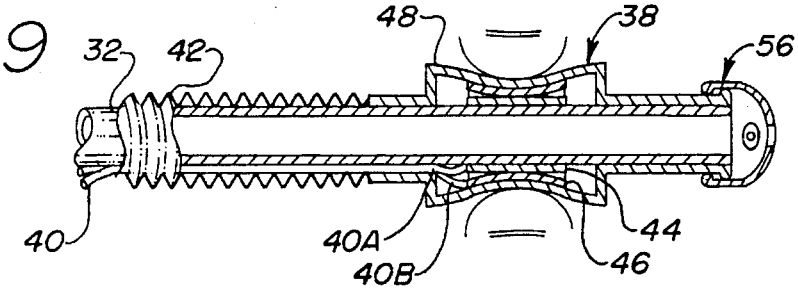
FIG. 9 is a sectional view as in FIG. 9 but showing fingers depressing switch.
Figure 10:
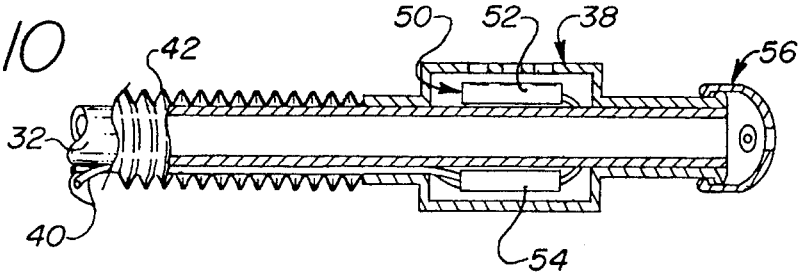
FIG. 10 is a sectional view showing an alternate embodiment using a voice activated switch.

Referring to FIGS. 8 and 9, in one embodiment, the switch 38 comprises an inner conductive surface 44, such as a metallic ring secured to the hose 32, and an outer conductive surface 46, such as a metallic ring held apart from and concentrically aligned with the conductor 44 by a resilient material 48. Wires 40A and 40B are connected to the conductors 44 and 46, respectively, so that when a user squeezes the resilient material 48, bringing conductors 44 and 46 into contact, as shown in FIG. 9, a circuit including the pump 28 and power source 34 is closed, activating the pump 28. When the user releases the resilient material 48, the conductors 44 and 46 are separated, as shown in FIG. 8, opening the circuit and deactivating the pump 28. In this arrangement, the switch 36 can be activated by the user's hand or teeth. As shown in FIG. 10, voice activation means 50, including an audio receiver or microphone 52 and an integrated circuit chip 54, can be provided on the end of the flexible hose 32 for voice activation of the pump 28.

A closure assembly 56 is located on the end of the flexible hose 32 for opening and closing the flexible hose 32 as well as for easy and comfortable reception within the user's mouth. As shown in FIGS. 8–10, closure assembly 56 can be a standard slide valve assembly. Extension of the slide valve opens the closure assembly 38 (FIGS. 9 and 10) and permits fluid flow therethrough, while retraction of the slide valve (FIG. 8) closes the closure assembly 56. Any other type of closure assembly including a cap that is either friction fittable or threadably attachable to the end of the flexible hose 32, or a unitary resilient valve as disclosed in U.S. Pat. No. 5,085,349 issued to Fawcett, can be utilized, In order to utilize the present invention the belt 10 is filled with any suitable liquid through fill cap 22. The user wraps and secures the belt 10 around his waist in the usual way, The belt 10 provides lower back support for the user without placing strain on the upper back and without raising the center of gravity, The closure assembly 56 is rendered open and the end of the flexible hose is received within the user's mouth or held in the user's hand and aimed at the user's mouth. The switch 38 is activated whenever the user desires to receive fluid from the device. When the switch 38 is activated, the pump 28 draws fluid from the bladder 22, through draw line 30 and pumps it through the flexible hose 32. When the switch 38 is deactivated, the pump 28 ceases its pumping function.

The flexible hose 32 can be clipped to the user's clothing in close proximity to the user's mouth so that the user does not have to hold the flexible hose 32 in his or her mouth or hands. Alternately, a strap can encompass the user's head and hold the end of the flexible hose 32 near the mouth. Because the pump 28 supplies a pressurized source of liquid, the liquid may be easily sprayed or poured from the hose 32 without the need for suction or hand operated pumping or squeezing actions. This, coupled with the long, flexible hose 32, gives a user the increased flexibility to easily pour or spray the liquid over the user's head or body or to easily share the liquid with others.

While the invention has been particularly shown and described with reference to an embodiment thereof, it will be understood by those skilled in the art that various changes in form and detail may be made without departing from the spirit and scope of the invention. For example, although the portable liquid containing and dispensing system is described as being a belt worn about a waist of a user, the system may take many forms and need not be worn as a belt. The system may be used in any number of situations and may be attached to countless other objects. For example, the system may be strapped or secured to bicycles, canoes, kayaks, and even automobiles, such by strapping the system to a roll bar in a race car, or in other situations in which it is desirable to have a readily available source of liquid while leaving a user's hands free.

I claim:

1. A portable apparatus for dispensing liquids to a user, comprising:

a pouch;

means for securing said pouch about a waist of the user;

a bladder for holding a liquid, said bladder being disposed within said pouch;

a pump in fluid connection with said bladder;

a power source operatively connected to said pump; and a hose in fluid connection with said pump for supplying liquid to the user.

2. The apparatus of claim 1 wherein said pump and said power source are disposed within said pouch.

3. The apparatus of claim 1 further comprising a closure for selectively opening and closing said hose.

4. The apparatus of claim 3 wherein said closure comprises a slide valve.

5. The apparatus of claim 1 wherein said pump has a switch for activating and deactivating said pump and wherein said switch is disposed remotely from said pump.

6. The apparatus of claim 5 wherein said switch is disposed on said securing means.

7. The apparatus of claim 5 wherein said switch is disposed on said hose.

8. The apparatus of claim 7 wherein said switch is voice activated.

9. The apparatus of claim 7 wherein said switch comprises:

an inner conductor secured to said hose; a resilient material secured to said hose near said inner conductor; and an outer conductor secured to said resilient material, said outer conductor being held apart from said inner conductor by said resilient material, and being movable from a first position out of contact with said inner conductor, in which an electrical circuit including said pump and said power source is open, to a second position in contact with said inner conductor in which said circuit is closed.

10. The apparatus of claim 9 wherein said inner and outer conductors comprise concentrically disposed metallic rings.

11. The apparatus of claim 10 wherein said pouch further comprises a hump disposed so as to support the lower back of the user.

12. A portable apparatus for dispensing liquids to a user comprising:

a pliable pouch;

means for securing said pouch to a desired object;

a pliable bladder for holding a liquid, said bladder being disposed within said pouch;

a pump disposed within said pouch, said pump being in fluid connection with said bladder;

a power source disposed within said pouch, said power source being operatively connected to said pump; and a hose in fluid connection with said pump for supplying liquid to a user.

13. The apparatus of claim 12 wherein said pump has a switch for activating and deactivating said pump and wherein said switch is disposed remotely from said pump.

14. The apparatus of claim 13 wherein said switch is disposed on said hose.

15. The apparatus of claim 14 wherein said pouch further comprises a hump disposed so as to support the lower back of the user.

16. A portable apparatus for dispensing liquids to a user comprising:

a pliable bladder for holding a liquid;

means for securing said bladder in belt-like fashion about a waist of the user;

a pump in fluid connection with said bladder;

a power source operatively connected to said pump; and a hose in fluid connection with said pump for supplying fluid to the user.

17. The apparatus of claim 16 wherein said pump has a switch for activating and deactivating said pump and wherein said switch is disposed remotely from said pump.

18. The apparatus of claim 17 wherein said switch is disposed on said hose.

19. The apparatus of claim 18 wherein said switch is voice activated.

20. The apparatus of claim 18 wherein said switch comprises:

an inner conductor secured to said hose;

a resilient material secured to said hose near said inner conductor; and an outer conductor secured to said resilient material, said outer conductor being held apart from said inner conductor by said resilient material, and being movable from a first position out of contact with said inner conductor, in which an electrical circuit including said pump and said power source is open, to a second position in contact with said inner conductor in which said circuit is closed.

21. The apparatus of claim 16 further comprising a closure for selectively opening and closing said hose.

22. The apparatus of claim 21 wherein said closure comprises a slide valve.

23. The apparatus of claim 22 wherein said bladder further comprises a hump disposed so as to support the lower back of the user.

* * * * *